US011332801B2

(12) United States Patent
Ehashi et al.

(10) Patent No.: US 11,332,801 B2
(45) Date of Patent: May 17, 2022

(54) METHOD OF PRODUCING GRAIN-ORIENTED ELECTRICAL STEEL SHEET

(71) Applicant: JFE STEEL CORPORATION, Tokyo (JP)

(72) Inventors: Yuiko Ehashi, Tokyo (JP); Masanori Takenaka, Tokyo (JP); Yasuyuki Hayakawa, Tokyo (JP); Minoru Takashima, Tokyo (JP); Takeshi Imamura, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 105 days.

(21) Appl. No.: 16/078,010

(22) PCT Filed: Mar. 9, 2017

(86) PCT No.: PCT/JP2017/009561
§ 371 (c)(1),
(2) Date: Aug. 15, 2018

(87) PCT Pub. No.: WO2017/155057
PCT Pub. Date: Sep. 14, 2017

(65) Prior Publication Data

US 2019/0271054 A1 Sep. 5, 2019

(30) Foreign Application Priority Data

Mar. 9, 2016 (JP) ..... JP2016-046016

(51) Int. Cl.
*C21D 9/46* (2006.01)
*C21D 6/00* (2006.01)
(Continued)

(52) U.S. Cl.
CPC ..... *C21D 9/46* (2013.01); *C21D 6/005* (2013.01); *C21D 6/008* (2013.01); *C21D 8/1222* (2013.01);
(Continued)

(58) Field of Classification Search
CPC ..... C21D 9/46; C22C 38/02
(Continued)

(56) References Cited

U.S. PATENT DOCUMENTS 3,932,234 A 1/1976 Imanaka et al.
4,468,551 A 8/1984 Neiheisel
(Continued)

FOREIGN PATENT DOCUMENTS

JP S38008214 B 6/1963
JP S4015644 B 7/1965
(Continued)

OTHER PUBLICATIONS

Jun. 4, 2019, Notification of Reasons for Refusal issued by the Japan Patent Office in the corresponding Japanese Patent Application No. 2018-504597 with English language concise statement of relevance.
(Continued)

*Primary Examiner* — Weiping Zhu
(74) *Attorney, Agent, or Firm* — Kenja IP Law PC

(57) ABSTRACT

To provide a grain-oriented electrical steel sheet that has better magnetic property than conventional ones without requiring high-temperature slab heating, in the case of not performing intermediate annealing, the hot rolled steel sheet obtained by a predetermined step is subjected to hot band annealing, and, in a heating process in the hot band annealing, heating is performed at a heating rate of 10° C./s or less for 10 sec or more and 120 sec or less in a temperature range of 700° C. or more and 950° C. or less, and in the case of performing the intermediate annealing, in a heating process
(Continued)

in final intermediate annealing, heating is performed at a heating rate of 10° C./s or less for 10 sec or more and 120 sec or less in a temperature range of 700° C. or more and 950° C. or less.

4 Claims, 1 Drawing Sheet

(51) Int. Cl.

| | |
|---|---|
| ***C21D 8/12*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/08*** | (2006.01) |
| ***C22C 38/12*** | (2006.01) |
| ***C22C 38/14*** | (2006.01) |
| ***C22C 38/16*** | (2006.01) |
| ***C22C 38/18*** | (2006.01) |
| ***C22C 38/40*** | (2006.01) |
| ***C22C 38/60*** | (2006.01) |
| ***H01F 1/16*** | (2006.01) |
| ***H01F 1/147*** | (2006.01) |

(52) U.S. Cl.
CPC ..... *C21D 8/1233* (2013.01); *C21D 8/1255* (2013.01); *C21D 8/1261* (2013.01); *C21D 8/1266* (2013.01); *C21D 8/1272* (2013.01); *C21D 8/1283* (2013.01); *C21D 8/1288* (2013.01); *C22C 38/001* (2013.01); *C22C 38/002* (2013.01); *C22C 38/008* (2013.01); *C22C 38/02* (2013.01); *C22C 38/04* (2013.01); *C22C 38/06* (2013.01); *C22C 38/08* (2013.01); *C22C 38/12* (2013.01); *C22C 38/14* (2013.01); *C22C 38/16* (2013.01); *C22C 38/18* (2013.01); *C22C 38/40* (2013.01); *C22C 38/60* (2013.01); *H01F 1/147* (2013.01); *H01F 1/16* (2013.01); *C22C 2202/02* (2013.01)

(58) Field of Classification Search
USPC ..... 148/111
See application file for complete search history.

(56) References Cited

U.S. PATENT DOCUMENTS

| | | | | |
|---|---|---|---|---|
| 4,919,733 | A | 4/1990 | Salsgiver et al. | |
| 4,979,997 | A | 12/1990 | Kobayashi et al. | |
| 9,187,798 | B2 * | 11/2015 | Takenaka | C21D 8/12 |
| 9,761,360 | B2 * | 9/2017 | Takenaka | C22C 38/60 |
| 2002/0011278 | A1 * | 1/2002 | Komatsubara | C22C 38/04 148/120 |
| 2009/0165895 | A1 | 7/2009 | Ushigami et al. | |
| 2012/0312424 | A1 | 12/2012 | Murakami et al. | |

FOREIGN PATENT DOCUMENTS

| | | | | |
|---|---|---|---|---|
| JP | S5113469 | B2 | | 4/1976 |
| JP | S5224116 | A | | 2/1977 |
| JP | H10102145 | A | | 4/1998 |
| JP | 2782086 | B2 | | 7/1998 |
| JP | 2000129356 | A | | 5/2000 |
| JP | 2003253336 | A | | 9/2003 |
| JP | 2008031498 | A | | 2/2008 |
| JP | 2010100885 | A | | 5/2010 |
| JP | 2011219793 | A | | 11/2011 |
| JP | 2015200002 | A | * | 11/2015 |
| JP | 2015200002 | A | | 11/2015 |

OTHER PUBLICATIONS

Dec. 14, 2018, Extended European Search Report issued by the European Patent Office in the corresponding European Patent Application No. 17763397.1.

May 23, 2017, International Search Report issued in the International Patent Application No. PCT/JP2017/009561.

T. Ros-Yañez et al., Production of high silicon steel for electrical applications by thermomechanical processing, Journal of Materials Processing Technology, 2003, pp. 132-137, vol. 141.

* cited by examiner

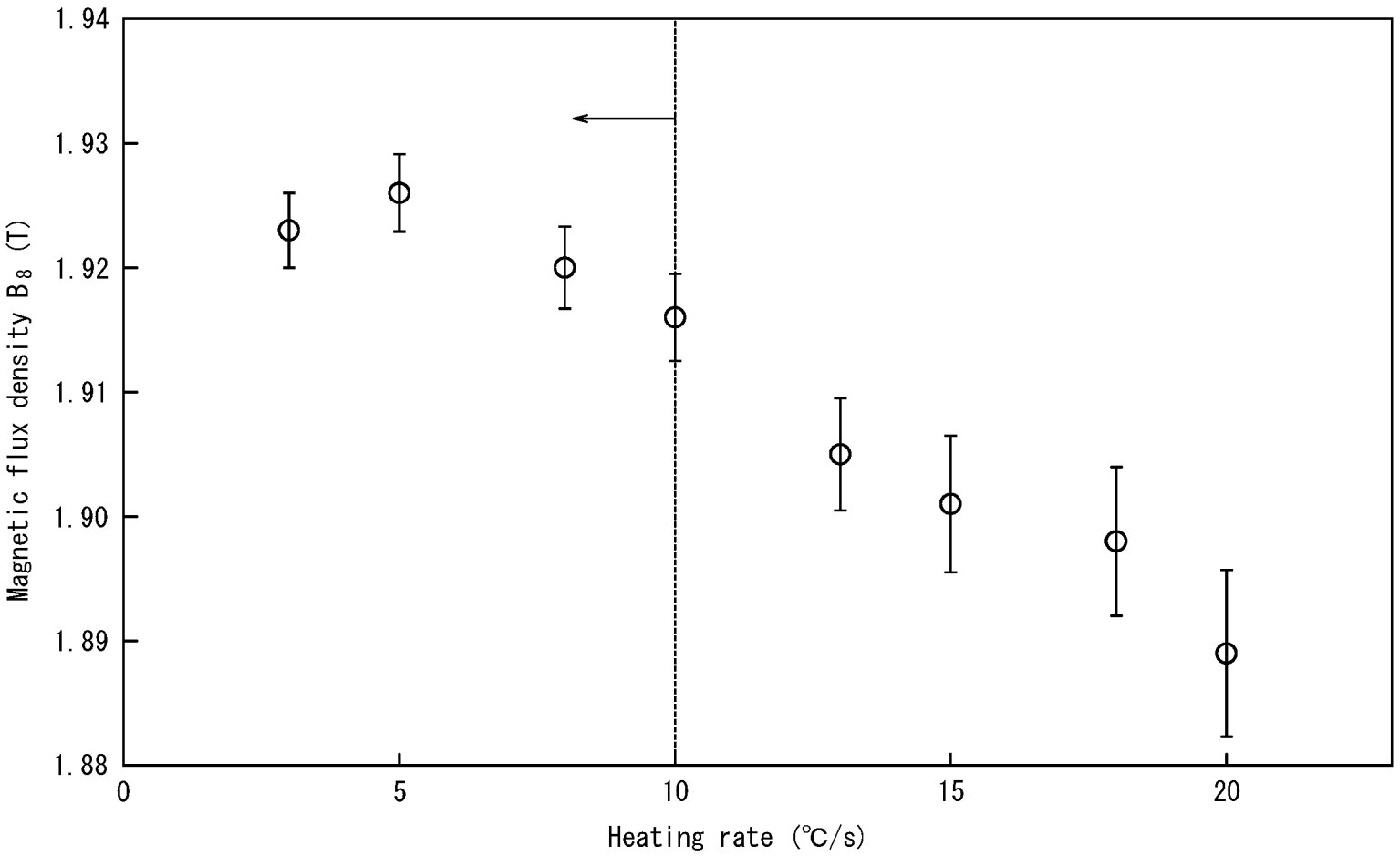
1.94
1.93
1.92
1.91
1.90
1.89
1.88
Magnetic flux density $B_8$ (T)
0
5
10
15
20
Heating rate (℃/s)

METHOD OF PRODUCING GRAIN-ORIENTED ELECTRICAL STEEL SHEET

TECHNICAL FIELD

The present disclosure relates to a method of producing a grain-oriented electrical steel sheet suitable for an iron core material of a transformer.

BACKGROUND

A grain-oriented electrical steel sheet is a soft magnetic material mainly used as an iron core material of an electrical device such as a transformer or a generator, and has crystal texture in which the <001> orientation which is the easy magnetization axis of iron is highly aligned with the rolling direction of the steel sheet. Such texture is formed through secondary recrystallization of preferentially causing the growth of giant crystal grains in the (110)[001] orientation which is called Goss orientation, when secondary recrystallization annealing is performed in the process of producing the grain-oriented electrical steel sheet.

A typical technique used for such a grain-oriented electrical steel sheet causes grains having Goss orientation to undergo secondary recrystallization during final annealing using a precipitate called an inhibitor. For example, JP S40-15644 B2 (PTL 1) discloses a method using AlN and MnS, and JP S51-13469 B2 (PTL 2) discloses a method using MnS and MnSe. These methods are in actual use industrially. These methods using inhibitors require slab heating at high temperature exceeding 1300° C., but are very useful in stably developing secondary recrystallized grains. To strengthen the function of such inhibitors, JP S38-8214 B2 (PTL 3) discloses a method using Pb, Sb, Nb, and Te, and JP S52-24116 A (PTL 4) discloses a method using Zr, Ti, B, Nb, Ta, V, Cr, and Mo.

Moreover, JP 2782086 B2 (PTL 5) proposes a method whereby the content of acid-soluble Al (sol.Al) is 0.010% to 0.060% and the content of N is reduced so that slab heating is controlled to low temperature and nitriding is performed in an appropriate nitriding atmosphere in decarburization annealing, as a result of which (Al, Si)N is precipitated and used as an inhibitor in secondary recrystallization.

CITATION LIST

Patent Literatures

PTL 1: JP S40-15644 B2
PTL 2: JP S51-13469 B2
PTL 3: JP S38-8214 B2
PTL 4: JP S52-24116 A
PTL 5: JP 2782086 B2
PTL 6: JP 2000-129356 A

SUMMARY

Technical Problem

Thus, (Al, Si)N disperses finely in the steel and functions as an effective inhibitor in the secondary recrystallization. However, since the inhibitor strength depends on the Al content, in the case where the accuracy of the Al content in the steelmaking is insufficient or in the case where the increase in the amount of N in the nitriding is insufficient, sufficient grain growth inhibiting capability may be unable to be obtained.

JP 2000-129356 A (PTL 6) discloses a technique of preferentially causing secondary recrystallization of Goss-oriented crystal grains using a raw material not containing an inhibitor component. This method does not require fine particle distribution of an inhibitor into steel, and so does not need to perform high-temperature slab heating which has been essential. Thus, the method is highly advantageous in terms of both cost and maintenance. However, since an inhibitorless raw material does not include an inhibitor having a function of inhibiting grain growth during primary recrystallization annealing to achieve uniform grain size, the resultant grain size distribution is not uniform, and excellent magnetic property is hard to be realized.

It could therefore be helpful to provide a method of producing a grain-oriented electrical steel sheet that stably has better magnetic property than conventional ones, without requiring high-temperature slab heating.

Solution to Problem

The following describes the experimental results that led to the present disclosure.

<Experiment>

Steel containing, in mass %, C: 0.04%, Si: 3.8%, acid-soluble Al: 0.005%, N: 0.003%, Mn: 0.1%, S: 0.005%, Se: 0.003%, and a balance being Fe and inevitable impurities was obtained by steelmaking, heated to 1250° C., and hot rolled to obtain a hot rolled sheet with a sheet thickness of 2.2 mm. The hot rolled sheet was then subjected to hot band annealing of 1030° C.×100 sec. The heating rate in the heating process in the hot band annealing was 3° C./s to 20° C./s in a temperature range of 750° C. to 850° C., and 15° C./s in the other temperature ranges. After this, cold rolling was performed once, to obtain a cold rolled sheet with a final sheet thickness of 0.22 mm.

Following this, primary recrystallization annealing also serving as decarburization of 860° C.×100 sec was performed in a wet atmosphere of 55 vol % $H_2$-45 vol % $N_2$. Subsequently, an annealing separator mainly composed of MgO was applied to the steel sheet surface and dried, and then final annealing including purification and secondary recrystallization of 1200° C.×5 hr was performed in a hydrogen atmosphere. Ten test pieces with a width of 100 mm were collected from the resultant steel sheet, and the magnetic flux density $B_8$ of each test piece was measured by the method prescribed in JIS C2556. FIG. 1 illustrates the measurement results, where the horizontal axis represents the heating rate in a temperature range of 750° C. to 850° C. in the heating process in the hot band annealing and the vertical axis represents the average value of the magnetic flux density $B_8$. As illustrated in FIG. 1, by heating the steel sheet at a rate of 10° C./s or less in a temperature range of 750° C. to 850° C. in the hot band annealing, excellent magnetic flux density was obtained without variations.

Although the reason that the magnetic flux density was improved by heating the steel sheet at a rate of 10° C./s or less in a temperature range of 750° C. to 850° C. in the heating process in the hot band annealing is not exactly clear, we consider the reason as follows. In this temperature range, phase transformation from α phase to γ phase occurs, and the phase transformation progresses (the proportion of γ phase increases) as the temperature increases. By lowering the heating rate, however, phase transformation nucleation sites decrease. As a result, γ phase that hinders the grain growth of α phase during the hot band annealing decreases in number, and the crystal grain size before the cold rolling coarsens and {411}-oriented grains of primary recrystallized texture increase, so that {110}<001>-oriented grains preferentially undergo secondary recrystallization. This contributes to excellent magnetic property.

Although the reason that variations in magnetic flux density were reduced is not exactly clear, we consider the reason as follows. In the case where the heating rate is high, phase transformation progresses rapidly, so that, due to non-uniformity of carbide after the hot rolling, the density of phase transformation nucleation sites changes and the crystal grain size before the cold rolling becomes non-uniform. By lowering the heating rate, however, the density of phase transformation nucleation sites becomes sparse as a whole, and the grain size before the cold rolling becomes uniform. Consequently, variations in the orientation of primary recrystallized texture caused by the grain size difference before the cold rolling are reduced, and variations in magnetic flux density are reduced.

The present disclosure is based on these experimental results and further studies. We thus provide the following.

1. A method of producing a grain-oriented electrical steel sheet, comprising: heating a steel slab in a temperature range of 1300° C. or less, the steel slab having a chemical composition containing (consisting of), in mass %, C: 0.02% or more and 0.08% or less, Si: 2.0% or more and 5.0% or less, Mn: 0.02% or more and 1.00% or less, S and/or Se: 0.0015% or more and 0.0100% or less in total, N: less than 0.006%, acid-soluble Al: less than 0.010%, and a balance being Fe and inevitable impurities; subjecting the steel slab to hot rolling, to obtain a hot rolled steel sheet; optionally subjecting the hot rolled steel sheet to hot band annealing; subjecting the hot rolled steel sheet after the hot rolling or after the hot band annealing to cold rolling once, or twice or more with intermediate annealing performed therebetween, to obtain a cold rolled steel sheet having a final sheet thickness; and subjecting the cold rolled steel sheet to primary recrystallization annealing and secondary recrystallization annealing, wherein in the case of not performing the intermediate annealing, the hot rolled steel sheet is subjected to the hot band annealing, and, in a heating process in the hot band annealing, heating is performed at a heating rate of 10° C./s or less for 10 sec or more and 120 sec or less in a temperature range of 700° C. or more and 950° C. or less, and in the case of performing the intermediate annealing, in a heating process in final intermediate annealing, heating is performed at a heating rate of 10° C./s or less for 10 sec or more and 120 sec or less in a temperature range of 700° C. or more and 950° C. or less.

2. The method of producing a grain-oriented electrical steel sheet according to 1, wherein the chemical composition further contains, in mass %, one or more selected from Sn: 0.5% or less, Sb: 0.5% or less, Ni: 1.5% or less, Cu: 1.5% or less, Cr: 0.1% or less, P: 0.5% or less, Mo: 0.5% or less, Ti: 0.1% or less, Nb: 0.1% or less, V: 0.1% or less, B: 0.0025% or less, Bi: 0.1% or less, Te: 0.01% or less, and Ta: 0.01% or less.

Advantageous Effect

It is thus possible to provide a grain-oriented electrical steel sheet that has better magnetic property than conventional ones without requiring high-temperature slab heating, by optimizing the heat pattern of the heating in the annealing (hot band annealing or intermediate annealing) immediately before the final cold rolling (i.e. by providing, in the heating process, a range in which heating is performed gradually at 10° C./s or less for 10 sec or more and 120 sec or less in a temperature range of 700° C. or more and 950° C. or less).

BRIEF DESCRIPTION OF THE DRAWINGS

In the accompanying drawings:

FIG. 1 is a graph illustrating the relationship between the heating rate and the magnetic flux density.

DETAILED DESCRIPTION

A method of producing a grain-oriented electrical steel sheet according to one of the disclosed embodiments is described below. The reasons for limiting the chemical composition of steel are described first. In the description, "%" representing the content (amount) of each component element denotes "mass %" unless otherwise noted.

C: 0.02% or More and 0.08% or Less

If the C content is less than 0.02%, α-γ phase transformation does not occur, and also carbides decrease, which lessens the effect by carbide control. If the C content is more than 0.08%, it is difficult to reduce, by decarburization annealing, the C content to 0.005% or less that causes no magnetic aging. The C content is therefore in a range of 0.02% or more and 0.08% or less. The C content is preferably in a range of 0.02% or more and 0.05% or less.

Si: 2.0% or More and 5.0% or Less

Si is an element necessary to increase the specific resistance of the steel and reduce iron loss. This effect is insufficient if the Si content is less than 2.0%. If the Si content is more than 5.0%, workability decreases and production by rolling is difficult. The Si content is therefore in a range of 2.0% or more and 5.0% or less. The Si content is preferably in a range of 2.5% or more and 4.5% or less.

Mn: 0.02% or More and 1.00% or Less

Mn is an element necessary to improve the hot workability of the steel. This effect is insufficient if the Mn content is less than 0.02%. If the Mn content is more than 1.00%, the magnetic flux density of the product sheet decreases. The Mn content is therefore in a range of 0.02% or more and 1.00% or less. The Mn content is preferably in a range of 0.05% or more and 0.70% or less.

S and/or Se: 0.0015% or More and 0.0100% or Less in Total

S and/or Se form MnS or $Cu_2S$ and/or MnSe or $Cu_2Se$, and also inhibit grain growth as solute S and/or Se, to exhibit a magnetic property stabilizing effect. If the total content of S and/or Se is less than 0.0015%, the amount of solute S and/or Se is insufficient, causing unstable magnetic property. If the total content of S and/or Se is more than 0.0100%, the dissolution of precipitates in slab heating before hot rolling is insufficient, causing unstable magnetic property. The total content of S and/or Se is therefore in a range of 0.0015% or more and 0.0100% or less. The total content of S and/or Se is preferably in a range of 0.0015% or more and 0.0070% or less.

N: Less than 0.006%

N may cause defects such as swelling in the slab heating. The N content is therefore less than 0.006%.

Acid-Soluble Al: Less than 0.010%

Al may form a dense oxide film on the surface and hamper decarburization. The Al content is therefore less than 0.010% in acid-soluble Al content. The Al content is preferably 0.008% or less.

The basic components according to the present disclosure have been described above. The balance other than the components described above is Fe and inevitable impurities. Additionally, to improve the magnetic property, one or more selected from Sn: 0.5% or less, Sb: 0.5% or less, Ni: 1.5% or less, Cu: 1.5% or less, Cr: 0.1% or less, P: 0.5% or less, Mo: 0.5% or less, Ti: 0.1% or less, Nb: 0.1% or less, V: 0.1% or less, B: 0.0025% or less, Bi: 0.1% or less, Te: 0.01% or less, and Ta: 0.01% or less may be optionally added as appropriate.

Since each of these components is effective if its content is more than 0% and the above-mentioned upper limit or less, no lower limit is placed on the content. However, preferable ranges are Sn: 0.001% or more, Sb: 0.001% or more, Ni: 0.005% or more, Cu: 0.005% or more, Cr: 0.005% or more, P: 0.005% or more, Mo: 0.005% or more, Ti: 0.005% or more, Nb: 0.0001% or more, V: 0.001% or more, B: 0.0001% or more, Bi: 0.001% or more, Te: 0.001% or more, and Ta: 0.001% or more.

Particularly preferable ranges are Sn: 0.1% or less, Sb: 0.1% or less, Ni: 0.8% or less, Cu: 0.8% or less, Cr: 0.08% or less, P: 0.15% or less, Mo: 0.1% or less, Ti: 0.05% or less, Nb: 0.05% or less, V: 0.05% or less, B: 0.0020% or less, Bi: 0.08% or less, Te: 0.008% or less, and Ta: 0.008% or less.

The production conditions for a grain-oriented electrical steel sheet according to the present disclosure are described below.

After obtaining steel having the chemical composition described above by steelmaking through a conventional refining process, a steel raw material (slab) may be produced by a known ingot casting and blooming method or continuous casting method, or a thin slab or thinner cast steel with a thickness of 100 mm or less may be produced by a direct casting method.

[Heating]

The slab is heated to a temperature of 1300° C. or less by a conventional method. Limiting the heating temperature to 1300° C. or less contributes to lower production cost. The heating temperature is preferably 1200° C. or more, in order to completely dissolve MnS or CuS and/or MnSe or CuSe.

[Hot Rolling]

After the heating, hot rolling is performed. The hot rolling is preferably performed with a start temperature of 1100° C. or more and a finish temperature of 750° C. or more, in terms of texture control. The finish temperature is preferably 900° C. or less, in terms of inhibiting capability control.

Alternatively, the slab may be directly hot rolled without heating, after the casting. In the case of a thin slab or thinner cast steel, it may be hot rolled and then subjected to the subsequent process, or subjected to the subsequent process without hot rolling.

[Hot Band Annealing]

After this, the hot rolled sheet is optionally hot band annealed. To obtain favorable magnetic property, the annealing temperature in the hot band annealing is desirably 1000° C. to 1150° C. in the case of performing cold rolling only once in the below-mentioned cold rolling, and 800° C. to 1200° C. in the case of performing cold rolling twice or more with intermediate annealing performed therebetween.

[Cold Rolling]

The hot rolled sheet is then cold rolled. In the case of rolling the hot rolled sheet to a final sheet thickness by performing cold rolling twice or more with intermediate annealing performed therebetween, the annealing temperature in the hot band annealing is desirably 800° C. to 1200° C. If the annealing temperature is less than 800° C., band texture formed in the hot rolling remains, which makes it difficult to realize primary recrystallized texture of uniformly-sized grains. As a result, the development of secondary recrystallization is hindered. If the annealing temperature is more than 1200° C., the grain size after the hot band annealing coarsens significantly, which makes it difficult to realize optimal primary recrystallized texture. The annealing temperature is therefore desirably 1200° C. or less. The holding time in this temperature range needs to be 10 sec or more, for uniform texture after the hot band annealing. Long-term holding, however, does not have a magnetic property improving effect, and so the holding time is desirably 300 sec or less in terms of operation cost. In the case of rolling the hot rolled sheet to the final sheet thickness by performing cold rolling twice or more with intermediate annealing performed therebetween, the hot band annealing may be omitted.

In the case of performing cold rolling only once (single cold rolling method), the hot band annealing is the annealing immediately before the final cold rolling, and accordingly the hot band annealing is essential. The annealing temperature in the hot band annealing is desirably 1000° C. or more and 1150° C. or less, in terms of controlling the grain size before the final cold rolling. The holding time in this temperature range needs to be 10 sec or more, for uniform texture after the hot band annealing. Long-term holding, however, does not have a magnetic property improving effect, and so the holding time is desirably 300 sec or less in terms of operation cost.

In the case of the single cold rolling method, heating needs to be performed at a heating rate of 10° C./s or less for 10 sec or more and 120 sec or less, in a temperature range of 700° C. or more and 950° C. or less in the heating process in the hot band annealing. Thus, phase transformation nucleation sites occurring in this temperature range decrease, and the hindrance of the crystal grain growth of $\alpha$ phase by $\gamma$ phase during holding in a temperature range of 1000° C. to 1150° C. can be prevented.

In the case of the double cold rolling method, the hot rolled steel sheet after the hot rolling or after the hot band annealing is subjected to cold rolling once, or twice or more with intermediate annealing performed therebetween, to obtain a cold rolled sheet with the final sheet thickness. The annealing temperature in the intermediate annealing is preferably in a range of 900° C. to 1200° C. If the annealing temperature is less than 900° C., recrystallized grains after the intermediate annealing are fine. Besides, Goss nuclei in the primary recrystallized texture tend to decrease, causing a decrease in the magnetic property of the product sheet. If the annealing temperature is more than 1200° C., the grain size coarsens significantly as in the hot band annealing, which makes it difficult to realize optimal primary recrystallized texture. In particular, the intermediate annealing before the final cold rolling is desirably in a temperature range of 1000° C. to 1150° C. The holding time needs to be 10 sec or more, for uniform texture after the hot band annealing. Long-term holding, however, does not have a magnetic property improving effect, and so the holding time is desirably 300 sec or less in terms of operation cost.

In the case of the double cold rolling method, heating needs to be performed at a heating rate of 10° C./s or less for 10 sec or more and 120 sec or less, in a temperature range of 700° C. or more and 950° C. or less in the heating process in the intermediate annealing before the final cold rolling. Thus, phase transformation nucleation sites occurring in this temperature range decrease, and the hindrance of the crystal grain growth of $\alpha$ phase by $\gamma$ phase during holding in a temperature range of 1000° C. to 1150° C. can be prevented.

In the cold rolling (final cold rolling) for obtaining the final sheet thickness, the rolling reduction is preferably 80% to 95% in order to allow for sufficient development of <111>//ND orientation in the primary recrystallization annealed sheet texture.

[Primary Recrystallization Annealing]

Primary recrystallization annealing is then performed. The primary recrystallization annealing may also serve as decarburization annealing. In terms of decarburization performance, the annealing temperature is preferably in a range of 800° C. to 900° C., and the atmosphere is preferably a wet atmosphere. By rapid heating at 30° C./s or more in a range of 500° C. to 700° C. in the heating process in the primary recrystallization annealing, recrystallization nuclei of Goss-oriented grains increase, which enables a reduction in iron loss. Hence, a grain-oriented electrical steel sheet having both high magnetic flux density and low iron loss can be yielded. If the heating rate is more than 400° C./s, excessive texture randomization occurs, and the magnetic property degrades. The heating rate is therefore 30° C./s or more and 400° C./s or less. The heating rate is preferably 50° C./s or more and 300° C./s or less.

[Application of Annealing Separator]

An annealing separator is applied to the steel sheet that has undergone the primary recrystallization annealing. The use of an annealing separator mainly composed of MgO enables, when secondary recrystallization annealing is performed subsequently, secondary recrystallized texture to develop and a forsterite film to form. In the case where a forsterite film is not needed with importance being put on blanking workability, MgO for forming a forsterite film is not used, and instead silica, alumina, or the like is used. The application of such an annealing separator is effectively performed by, for example, electrostatic coating that does not introduce moisture. A heat-resistant inorganic material sheet (silica, alumina, or mica) may be used.

[Secondary Recrystallization Annealing]

After this, secondary recrystallization annealing (final annealing) is performed. To develop secondary recrystallization, the secondary recrystallization annealing is preferably performed at 800° C. or more. To complete the secondary recrystallization, the steel sheet is preferably held at a temperature of 800° C. or more for 20 hr or more. Further, to form a favorable forsterite film, it is preferable to heat the steel sheet to a temperature of about 1200° C. and hold it for 1 hr or more.

[Flattening Annealing]

The steel sheet after the secondary recrystallization annealing is then subjected to water washing, brushing, pickling, or the like to remove unreacted annealing separator adhering to the steel sheet surface, and then subjected to flattening annealing for shape adjustment, which effectively reduces iron loss. The is because the steel sheet has a tendency to coil up due to the secondary recrystallization annealing typically being carried out on the steel sheet in a coiled state, which causes property degradation in iron loss measurement. The annealing temperature in the flattening annealing is preferably 750° C. to 1000° C., and the annealing time is preferably 10 sec or more and 30 sec or less.

[Formation of Insulating Coating]

In the case of using the steel sheet in a stacked state, it is effective to form an insulation coating on the steel sheet surface before or after the flattening annealing. In particular, for iron loss reduction, a tension-applying coating capable of imparting tension to the steel sheet is preferable as the insulating coating. By using, in the formation of the tension-applying coating, a method of applying a tension coating through a binder or a method of depositing an inorganic substance onto the steel sheet surface layer by physical vapor deposition or chemical vapor deposition, an insulating coating with excellent coating adhesion and considerable iron loss reduction effect can be formed.

[Magnetic Domain Refining Treatment]

In addition, magnetic domain refining treatment may be performed to further reduce iron loss. The treatment method may be a typical method such as grooving the steel sheet after final annealing, introducing thermal strain or impact strain in a linear or dot-sequence manner by electron beam irradiation, laser irradiation, plasma irradiation, etc., or grooving the steel sheet in an intermediate process, such as the steel sheet cold rolled to the final sheet thickness, by etching the steel sheet surface.

The other production conditions may comply with typical grain-oriented electrical steel sheet production methods.

EXAMPLES

Example 1

Each steel containing, in mass %, C: 0.05%, Si: 3.0%, acid-soluble Al: 0.005%, N: 0.003%, Mn: 0.06%, S: 0.004%, and a balance being Fe and inevitable impurities was obtained by steelmaking, heated to 1250° C., and hot rolled to obtain a hot rolled steel sheet with a sheet thickness of 2.4 mm. The hot rolled steel sheet was then subjected to hot band annealing of 1000° C.×100 sec, and further subjected to cold rolling twice with intermediate annealing of 1030° C.×100 sec performed therebetween, to obtain a cold rolled steel sheet with a final sheet thickness of 0.27 mm. The heating process in the intermediate annealing was performed under the conditions listed in Table 1. The heating rate outside the indicated temperature range was the rate for heating up to 1000° C.

Following this, primary recrystallization annealing also serving as decarburization annealing of 840° C.×100 sec was performed in a wet atmosphere of 55 vol % $H_2$-45 vol % $N_2$. Subsequently, an annealing separator mainly composed of MgO was applied to the steel sheet surface and dried, and then final annealing including purification treatment and secondary recrystallization of 1200° C.×5 hr was performed in a hydrogen atmosphere. Ten test pieces with a width of 100 mm were collected from the resultant steel sheet, and the magnetic flux density $B_8$ of each test piece was measured by the method prescribed in JIS C2556. The average value, maximum value, and minimum value of the measured magnetic flux density $B_8$ are listed in Table 1. The results in Table 1 demonstrate that, by heating the steel sheet at a rate of 10° C./s or less for 10 sec or more and 120 sec or less in a temperature range of 700° C. or more and 950° C. or less in the annealing before the final cold rolling, the magnetic flux density $B_8$ indicating magnetic property was improved and the variations were reduced.

TABLE 1

| No. | Temperature range (° C.) | Heating rate (° C./s) | Time in temperature range in left column (s) | Heating rate outside temperature range in left column (° C./s) | Magnetic flux density $B_8$ Average value (T) | Maximum value (T) | Minimum value (T) | Remarks |
|---|---|---|---|---|---|---|---|---|
| 1 | 600 to 700 | 3 | 33 | 15 | 1.889 | 1.902 | 1.881 | Comparative Example |
| 2 | 600 to 700 | 10 | 10 | 15 | 1.897 | 1.909 | 1.883 | Comparative Example |
| 3 | 650 to 700 | 3 | 17 | 15 | 1.902 | 1.913 | 1.893 | Comparative Example |
| 4 | 650 to 700 | 10 | 5 | 15 | 1.904 | 1.911 | 1.886 | Comparative Example |
| 5 | 700 to 800 | 3 | 33 | 15 | 1.928 | 1.932 | 1.925 | Example |
| 6 | 700 to 800 | 10 | 10 | 15 | 1.927 | 1.932 | 1.923 | Example |
| 7 | 700 to 800 | 13 | 8 | 15 | 1.907 | 1.917 | 1.896 | Comparative Example |
| 8 | 800 to 900 | 3 | 33 | 15 | 1.929 | 1.934 | 1.925 | Example |
| 9 | 800 to 900 | 10 | 10 | 15 | 1.927 | 1.930 | 1.924 | Example |
| 10 | 800 to 900 | 13 | 8 | 15 | 1.905 | 1.918 | 1.892 | Comparative Example |
| 11 | 900 to 950 | 3 | 17 | 15 | 1.932 | 1.935 | 1.927 | Example |
| 12 | 900 to 950 | 10 | 5 | 15 | 1.897 | 1.915 | 1.891 | Comparative Example |
| 13 | 950 to 1000 | 3 | 33 | 15 | 1.908 | 1.917 | 1.895 | Comparative Example |
| 14 | 700 to 900 | 3 | 67 | 15 | 1.931 | 1.935 | 1.928 | Example |
| 15 | 700 to 900 | 10 | 20 | 15 | 1.928 | 1.932 | 1.925 | Example |
| 16 | 700 to 900 | 13 | 15 | 15 | 1.908 | 1.911 | 1.893 | Comparative Example |
| 17 | 800 to 850 | 3 | 17 | 15 | 1.927 | 1.930 | 1.923 | Example |
| 18 | 800 to 850 | 10 | 5 | 15 | 1.906 | 1.915 | 1.897 | Comparative Example |
| 19 | 800 to 810 | 0.1 | 100 | 15 | 1.929 | 1.933 | 1.924 | Example |
| 20 | 900 to 1000 | 3 | 33 | 15 | 1.908 | 1.916 | 1.901 | Comparative Example |
| 21 | 900 to 1000 | 10 | 10 | 15 | 1.892 | 1.906 | 1.885 | Comparative Example |
| 22 | 800 to 850 | 5.5 | 9 | 15 | 1.905 | 1.910 | 1.893 | Comparative Example |
| 23 | 700 to 950 | 2 | 125 | 15 | 1.899 | 1.918 | 1.895 | Comparative Example |

Example 2

Each steel having the chemical composition listed in Table 2 was obtained by steelmaking, heated to 1300° C., and hot rolled to obtain a hot rolled steel sheet with a sheet thickness of 2.2 mm. The hot rolled steel sheet was then subjected to hot band annealing of 1060° C.×50 sec, with a heating rate of 2° C./s from 900° C. to 950° C. and a heating rate of 15° C./s in the other temperature ranges in the heating process in the hot band annealing. The hot rolled steel sheet was subsequently subjected to cold rolling once, to obtain a cold rolled steel sheet with a final sheet thickness of 0.23 mm. Following this, primary recrystallization annealing also serving as decarburization annealing of 850° C.×100 sec was performed in a wet atmosphere of 55 vol % $H_2$-45 vol % $N_2$.

Subsequently, an annealing separator mainly composed of MgO was applied to the steel sheet surface and dried, and then final annealing including purification treatment and secondary recrystallization of 1200° C.×5 hr was performed in a hydrogen atmosphere. Ten test pieces with a width of 100 mm were collected from the resultant steel sheet, and the magnetic flux density $B_8$ of each test piece was measured by the method prescribed in JIS C2556. The average value, maximum value, and minimum value of the measured magnetic flux density $B_8$ are listed in Table 2. The results in Table 2 demonstrate that, by the steel sheet having the chemical composition defined in the present disclosure, the magnetic property was improved and the variations were reduced.

TABLE 2

| No. | Chemical composition (mass %) C | Si | Mn | Al | N | Se | S | Others | Magnetic flux density $B_8$ Average value (T) | Maximum value (T) | Minimum value (T) | Remarks |
|---|---|---|---|---|---|---|---|---|---|---|---|---|
| 1 | 0.01 | 3.2 | 0.08 | 0.006 | 0.003 | 0.0030 | 0.0040 | — | 1.860 | 1.872 | 1.851 | Comparative Example |
| 2 | 0.09 | 3.2 | 0.08 | 0.006 | 0.003 | 0.0031 | 0.0039 | — | 1.875 | 1.883 | 1.860 | Comparative Example |
| 3 | 0.05 | 1.8 | 0.08 | 0.007 | 0.002 | 0.0031 | 0.0040 | — | 1.889 | 1.906 | 1.880 | Comparative Example |
| 4 | 0.05 | 3.1 | 0.01 | 0.006 | 0.003 | 0.0030 | 0.0039 | — | 1.882 | 1.895 | 1.874 | Comparative Example |
| 5 | 0.07 | 3.3 | 1.20 | 0.005 | 0.003 | 0.0030 | 0.0040 | — | 1.891 | 1.905 | 1.883 | Comparative Example |
| 6 | 0.04 | 3.3 | 0.09 | 0.011 | 0.003 | 0.0032 | 0.0040 | — | 1.870 | 1.891 | 1.865 | Comparative Example |
| 7 | 0.03 | 3.0 | 0.11 | 0.004 | 0.007 | 0.0030 | 0.0038 | — | 1.850 | 1.864 | 1.845 | Comparative Example |
| 8 | 0.03 | 2.9 | 0.12 | 0.007 | 0.004 | 0.0120 | — | — | 1.877 | 1.883 | 1.870 | Comparative Example |
| 9 | 0.06 | 2.8 | 0.08 | 0.005 | 0.003 | — | 0.0130 | — | 1.879 | 1.887 | 1.875 | Comparative Example |
| 10 | 0.05 | 3.6 | 0.05 | 0.009 | 0.002 | 0.0014 | — | — | 1.881 | 1.886 | 1.873 | Comparative Example |
| 11 | 0.05 | 3.6 | 0.06 | 0.008 | 0.003 | — | 0.0013 | — | 1.906 | 1.915 | 1.889 | Comparative Example |
| 12 | 0.06 | 4.0 | 0.08 | 0.007 | 0.003 | 0.0030 | 0.0040 | — | 1.925 | 1.930 | 1.921 | Example |
| 13 | 0.02 | 3.0 | 0.10 | 0.006 | 0.003 | 0.0031 | 0.0040 | — | 1.921 | 1.925 | 1.918 | Example |
| 14 | 0.08 | 3.0 | 0.10 | 0.006 | 0.003 | 0.0031 | 0.0040 | — | 1.924 | 1.928 | 1.920 | Example |
| 15 | 0.05 | 2.0 | 0.10 | 0.006 | 0.003 | 0.0031 | 0.0041 | — | 1.930 | 1.934 | 1.925 | Example |
| 16 | 0.05 | 5.0 | 0.10 | 0.006 | 0.003 | 0.0033 | 0.0042 | — | 1.925 | 1.929 | 1.921 | Example |
| 17 | 0.05 | 3.0 | 0.02 | 0.006 | 0.004 | 0.0030 | 0.0041 | — | 1.920 | 1.924 | 1.918 | Example |
| 18 | 0.05 | 3.0 | 1.00 | 0.005 | 0.004 | 0.0030 | 0.0010 | — | 1.927 | 1.931 | 1.924 | Example |
| 19 | 0.04 | 3.0 | 0.07 | 0.009 | 0.004 | 0.0030 | 0.0010 | — | 1.920 | 1.924 | 1.917 | Example |

TABLE 2-continued

| No. | Chemical composition (mass %) C | Si | Mn | Al | N | Se | S | Others | Magnetic flux density $B_8$ Average value (T) | Maximum value (T) | Minimum value (T) | Remarks |
|---|---|---|---|---|---|---|---|---|---|---|---|---|
| 20 | 0.04 | 3.0 | 0.07 | 0.005 | 0.005 | 0.0032 | 0.0010 | — | 1.920 | 1.925 | 1.917 | Example |
| 21 | 0.04 | 3.5 | 0.07 | 0.003 | 0.004 | 0.0015 | — | — | 1.923 | 1.928 | 1.920 | Example |
| 22 | 0.03 | 3.5 | 0.07 | 0.007 | 0.004 | — | 0.0015 | — | 1.924 | 1.927 | 1.920 | Example |
| 23 | 0.07 | 3.5 | 0.08 | 0.003 | 0.002 | 0.0100 | — | — | 1.920 | 1.926 | 1.917 | Example |
| 24 | 0.07 | 3.5 | 0.08 | 0.003 | 0.003 | — | 0.0010 | — | 1.921 | 1.925 | 1.916 | Example |
| 25 | 0.06 | 3.2 | 0.05 | 0.005 | 0.003 | 0.0030 | 0.0021 | Sn 0.1, Ni 0.8 | 1.931 | 1.935 | 1.926 | Example |
| 26 | 0.04 | 3.3 | 0.09 | 0.005 | 0.003 | 0.0031 | 0.0020 | Sb 0.1, Co 1.5 | 1.930 | 1.933 | 1.924 | Example |
| 27 | 0.04 | 4.5 | 0.06 | 0.005 | 0.003 | 0.0012 | 0.0010 | Cr 0.1, P 0.5 | 1.930 | 1.935 | 1.928 | Example |
| 28 | 0.07 | 3.4 | 1.00 | 0.007 | 0.004 | 0.0020 | — | Mo 0.1, Ti 0.05 | 1.931 | 1.936 | 1.927 | Example |
| 29 | 0.04 | 2.0 | 1.00 | 0.005 | 0.003 | 0.0020 | 0.0020 | Nb 0.05, B 0.002 | 1.927 | 1.932 | 1.923 | Example |
| 30 | 0.02 | 3.1 | 0.35 | 0.006 | 0.003 | 0.0030 | 0.0020 | V 0.05, Bi 0.08, Ta 0.008 | 1.933 | 1.937 | 1.929 | Example |
| 31 | 0.06 | 3.4 | 0.05 | 0.006 | 0.003 | — | 0.0031 | Te 0.008, B 0.002, Cu 0.01 | 1.929 | 1.934 | 1.925 | Example |
| 32 | 0.08 | 3.1 | 0.03 | 0.006 | 0.004 | 0.0022 | 0.0030 | Ni 0.01, Bi 0.005, Cr 0.01 | 1.934 | 1.937 | 1.930 | Example |
| 33 | 0.04 | 3.7 | 0.06 | 0.009 | 0.005 | 0.0022 | 0.0023 | Mo 0.01, V 0.005, Sn 0.01 | 1.929 | 1.934 | 1.925 | Example |
| 34 | 0.02 | 3.2 | 0.05 | 0.008 | 0.005 | 0.0010 | 0.0020 | Sb 0.005, Nb 0.0005, P 0.008 | 1.935 | 1.938 | 1.931 | Example |
| 35 | 0.03 | 3.2 | 0.08 | 0.007 | 0.004 | — | 0.0020 | Cu 0.08, P 0.05, Sn 0.05 | 1.932 | 1.936 | 1.927 | Example |

The invention claimed is:

1. A method of producing a grain-oriented electrical steel sheet, comprising:

heating a steel slab in a temperature range of 1300° C. or less, the steel slab having a chemical composition containing, in mass %, C: 0.02% or more and 0.08% or less, Si: 2.0% or more and 5.0% or less, Mn: 0.02% or more and 1.00% or less, S and/or Se: 0.0015% or more and 0.0100% or less in total, N: less than 0.006%, acid-soluble Al: less than 0.010%, and a balance being Fe and inevitable impurities;

subjecting the steel slab to hot rolling, to obtain a hot rolled steel sheet;

optionally subjecting the hot rolled steel sheet to hot band annealing;

subjecting the hot rolled steel sheet after the hot rolling or after the hot band annealing to cold rolling once, or twice or more with intermediate annealing performed therebetween, to obtain a cold rolled steel sheet having a final sheet thickness; and subjecting the cold rolled steel sheet to primary recrystallization annealing and secondary recrystallization annealing, wherein in the case of not performing the intermediate annealing, the hot rolled steel sheet is subjected to the hot band annealing, and, in a heating process in the hot band annealing, a heating rate is maintained at 3° C./s or less for 10 sec or more and 120 sec or less in a part of a temperature range of 700° C. or more and 950° C. or less, and in the case of performing the intermediate annealing, in a heating process in final intermediate annealing, a heating rate is maintained at 3° C./s or less for 10 sec or more and 120 sec or less in a part of a temperature range of 700° C. or more and 950° C. or less.

2. The method of producing a grain-oriented electrical steel sheet according to claim 1, wherein the heating rate in the case of not performing the intermediate annealing is maintained at 2° C./s or more and 3° C./s or less, and the heating rate in the case of performing the intermediate annealing is maintained at 2° C./s or more and 3° C./s or less.

3. The method of producing a grain-oriented electrical steel sheet according to claim 1, wherein the chemical composition further contains, in mass %, one or more selected from Sn: 0.5% or less, Sb: 0.5% or less, Ni: 1.5% or less, Cu: 1.5% or less, Cr: 0.1% or less, P: 0.5% or less, Mo: 0.5% or less, Ti: 0.1% or less, Nb: 0.1% or less, V: 0.1% or less, B: 0.0025% or less, Bi: 0.1% or less, Te: 0.01% or less, and Ta: 0.01% or less.

4. The method of producing a grain-oriented electrical steel sheet according to claim 3, wherein the heating rate in the case of not performing the intermediate annealing is maintained at 2° C./s or more and 3° C./s or less, and the heating rate in the case of performing the intermediate annealing is maintained at 2° C./s or more and 3° C./s or less.

* * * * *